United States Patent [19]

Meixner et al.

[11] 4,371,778

[45] Feb. 1, 1983

[54] ELECTRIC HEATING DEVICE EMPLOYING PTC HEATING ELEMENT FOR PREHEATING OF HEATING OIL

[75] Inventors: Hans Meixner, Haar; Andreas Schebler, Wuerzburg, both of Fed. Rep. of Germany

[73] Assignee: Siemens Aktiengesellschaft, Berlin & Munich, Fed. Rep. of Germany

[21] Appl. No.: 72,285

[22] Filed: Sep. 4, 1979

[30] Foreign Application Priority Data

Sep. 15, 1978 [DE] Fed. Rep. of Germany ..... 2840242

[51] Int. Cl.[3] ..... F02M 31/12; H05B 1/02; H05B 3/14

[52] U.S. Cl. ..... 219/302; 138/33; 219/205; 219/301; 219/308; 219/315; 219/328; 219/505; 219/535; 431/11; 431/41; 431/208

[58] Field of Search ..... 219/205, 214, 296–309, 219/504, 505, 535, 328, 315; 138/33; 431/11, 41, 207, 208

[56] References Cited

U.S. PATENT DOCUMENTS

| | | | |
|---|---|---|---|
| 1,140,864 | 5/1915 | Aubery | 219/301 |
| 1,413,681 | 4/1922 | Piggins | 219/301 X |
| 1,423,742 | 7/1922 | Silverman | 138/33 X |
| 2,104,940 | 1/1938 | Woolery | 431/41 |
| 2,397,988 | 4/1946 | Senninger | 431/41 |
| 3,338,476 | 8/1967 | Marcoux | 219/214 X |
| 3,375,774 | 4/1968 | Fujimura et al. | 219/505 X |
| 3,564,199 | 2/1971 | Blaha | 219/505 X |
| 3,824,328 | 7/1974 | Ting et al. | 219/504 X |
| 4,045,763 | 8/1977 | Miyamoto et al. | 219/504 X |
| 4,177,375 | 12/1979 | Meixner | 219/504 X |
| 4,223,208 | 9/1980 | Kleinschmidt et al. | 219/504 X |
| 4,230,935 | 10/1980 | Meixner | 219/504 X |

FOREIGN PATENT DOCUMENTS

| | | | |
|---|---|---|---|
| 2316054 | 10/1974 | Fed. Rep. of Germany | 219/504 |
| 2743880 | 4/1979 | Fed. Rep. of Germany . | |
| 262280 | 12/1926 | United Kingdom | 219/301 |

OTHER PUBLICATIONS

German Utility Model GM 78 11098 (Gebrauchsmuster), published Aug. 24, 1978.

German Utility Model GM 78 04316 (Gebrauchsmuster), published Nov. 11, 1978.

"Feuerungstechik", (Fuel Engineering), May 1978, pp. 13–30.

*Primary Examiner*—A. Bartis

*Attorney, Agent, or Firm*—Hill, Van Santen, Steadman, Chiara & Simpson

[57] ABSTRACT

A heating device for preheating heating oil flowing through a pipe has a heat conduction body to which a plate-shaped ceramic PTC resistance heating element is connected in heat exchange-relationship. The heating element has a thickness in the range of 0.5 to 2 millimeters, a Curie temperature between 120° and 220° C. and a specific resistance of 430 to 5000 ohm-cm rated at a supply voltage between 110 and 220 volts such that the maximum temperature achieved by the heating element over a range of heat transfer rates is relatively constant and is determined by the resistivity and the Curie temperature of the heating element rather than by the rate of heat transfer. If designed for energization at 220 volts, the heating element has the same thickness and Curie temperature as in the first example described above, but with a specific resistance of 1700 to 20,000 ohm-cm as measured at 220 volts.

3 Claims, 3 Drawing Figures

ELECTRIC HEATING DEVICE EMPLOYING PTC HEATING ELEMENT FOR PREHEATING OF HEATING OIL

BACKGROUND OF THE INVENTION

1. Field of the Invention

The present invention relates to a heating device, and more particularly to a heating device which is mounted on a pipe and which transfers its heat to the heating oil flowing therethrough.

2. Description of the Prior Art

Today, with the increasing scarcity of heating oil combined with the increasing demands for clean exhaust gases, i.e., free of harmful substances, an electrical preheating of the heating oil, for oil burners is desirable. Through the resultant reduction in the viscosity of the heating oil attained thereby, lesser charge quantities, for example under 1.4 kilograms per hour, can be dependably atomized. Further details of this matter can found in: feuerungstechnik (Fuel Engineering), May 1978, pages 13 through 30.

Especially for small installations, the oil burners which are commercially in general use today are designed so that they can be used over a relatively large range of desired thermal outputs. To accommodate the special needs of each individual customer requires only the installation of a particular nozzle and an adjustment of the air supply. If however, the oil burner also includes a resistance-heated electrical preheater, then this would have to be controlled in relation to the varying oil charge rate. This would create a significant difficulty for the operation of the burner. One would have to worry that a sufficiently high heating of the oil, for example to over 70° C., is attained, and indeed a relatively fast attainment of the final state is required. However, in perhaps the case of a brief stand-still or during interruption of the oil feed, no oil overheating can be permitted to occur with the resulting vapor formation and the likely multi-phase conveyance problems associated therewith. An electrical heating by means of a filament winding would also make very expensive control electronics necessary. In spite of these problems however, the attempt is always being made to design such oil burner to be as simple as possible yet also reliable.

Thus the problem presented is to create a heating device for the preheating of heating oil which will, without any particular installation work, take care of an amount of the oil feed which ranges over an order of magnitude, which device can easily be installed in preexisting oil burner installations, and which can be operated both at 110 volts at 220 volts without the necessity of a converter.

SUMMARY OF THE INVENTION

The use of ceramic Positive Temperature Coefficient, (PTC), conductors for heating in various different employments has been known for decades. By a ceramic PTC conductor, it is meant a component of a material built upon a base of barium titante and which, by means of manufacturing measures including dopings, which are essentially known, has a self-controlling temperature resistance characteristic affect wherein with a further increase in the temperature, the specific electrical resistance exhibits an extreme rise in value. The temperature at which this begins to occur is termed the Curie temperature for that substance. FIG. 1 shows a diagram which plots the temperature-resistance relationship with the citing of the Curie temperature and having a slope:

$$\alpha = \frac{1}{T - Tc} \log (\rho/\rho_o),$$

$\alpha$ in %/°C.

From the German patent application P-No. 27 43 880.8 and the German Utility Model G No. 78 04 316, details for the essential construction of a heating device using a ceramic PTC conductor material are known. These principals are also to be used in the present invention. Also, these references specify the general physical properties made use of in such a heating device. The present invention concerns both the use of a ceramic PTC conductor heating device for the preheating of heating oil and also encompasses the balancing with respect to the dimensions which is necessary for this application. A heating device has resulted which can be used for any oil feed amount within the relatively broad range of 0.3 to 2.5 liters per hour, which covers the amounts typically used for heating. In addition, this device is suitable without further modification for an electrical system of 110 volts as well as for one of 220 volts. Thus, this heating device requires no additional adjustments when within the range of oil feed rates.

It was expected that for such a large range of the quantities of oil required to be heated and perhaps also because of the differing operating voltages, significant individual accommodations and adjustments would be necessary. Surprisingly, with the present invention such adjustments are unnecessary when operating within the desired range. Thereby, it is assumed that the amount of heating of the heating oil which is fed in at greater feed rates, (within the framework of the cited range), need not be as great as for the feed rate of 0.3 liters per hour which lies at the lower limit.

Various other objects, advantages, and features of the present invention will become readily apparent from the ensuing detailed description and the novel feature will be particularly pointed out in the appended claims.

DESCRIPTION OF THE PREFERRED EMBODIMENTS

Figure 1:
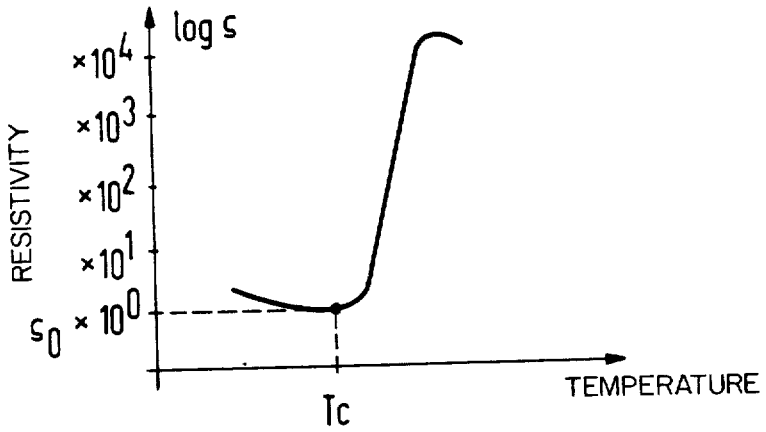
FIG. 1 is a graph depicting the relationship between the temperature and electrical resistance for a typical ceramic PTC conductor as utilized in this invention.
Figure 2:
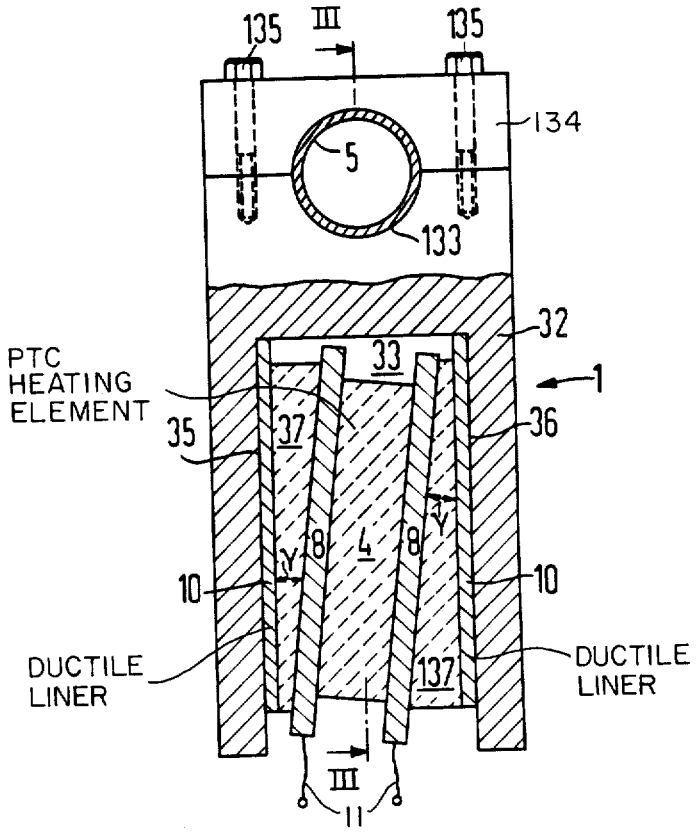
FIG. 2 is a end elevational view, partially in section, showing an embodiment of the present invention.
Figure 3:
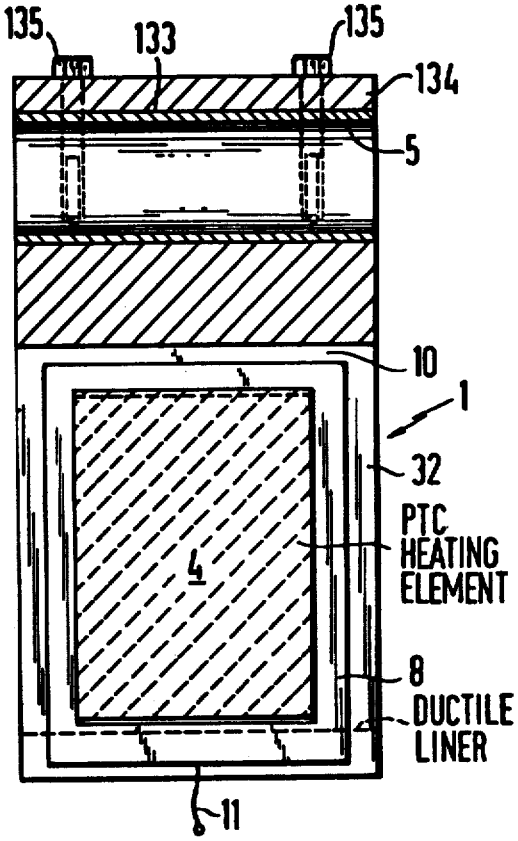
FIG. 3 is a side elevational view of the device shown in FIG. 2.

An embodiment of a heating device according to the invention is shown in FIG. 2. In the case of this embodiment, details are present which are also specified in the German Utility Model G No. 78 11 098. FIG. 2 shows a heating device 1 which has a heat conduction body 32 with an interspace 33 which is provided for receiving a ceramic PTC resistance heating element 4. This heating element may have physical dimensions as hereinafter recited. On the surfaces of this plate-spaced heating element 4, standing perpendicular to the plane containing FIG. 2, there are located electrodes 8 which are shown in section. The heating element 4, with the help of wedge-shaped bodies 37 and 137 which display a wedge angle $\gamma$, is wedged into the interspace 33 providing a solid seating with good heat conduction between both surfaces of the heating element 4 and the heat conducting planes 35 and 36 of the heat conduction body 32.

Ductile liners 10 are provided between the wedge-shaped bodies 37 and 137 and the heat conducting planes 35 and 36. Connection lines 11 connect the electrodes 8 to a power supply of either 110 or 220 volts, (or any voltage lying between those values).

The portion of the heat conduction body 32 in FIG. 2 has a semicircular shaped cylindrical recess 133, for closely receiving a pipe and obtaining good heat conduction therewith. Typically, copper pipe 5 is used for the conveyance of oil from the tank installation to the burner. A counterpart 134 is provided which mates with the portion 32 forming a throughbore for receiving the pipe 5. Part 134 has a recess which corresponds to the recess 133. With the help of fastening means such as the bolts 135, this part 134 can be fastened on the heat conduction body 32, as shown, such that the copper pipe 5 of the oil conveyance line is gripped solidly and with good heat contact. The part piece 134 may be replaced by a perhaps a less expensive mounting of the heat conduction body 32 at the pipe 5.

A heat conduction body 32 for a heating device according to the invention has, for example, for the range of oil feed rates previously recited, a dimensioned length (perpendicular to the plane of FIG. 2) of approximately 4.5 centimeters for a pipe 5 with an 8 millimeter exterior diameter.

The present invention may be further described in light of the following examples. The ceramic PTC conductor-heating element 4 has a thickness of approximately 0.5 to 2 millimeters with the total area of both plate surfaces of 10 square centimeters. As a ceramic PTC conductor material for a prescribed operating voltage of 220 volts, one is selected which has a Curie temperature, $T_c$, of 160° C., and at this reference temperature $T_c$, displays a specific electrical resistance $\rho$ of approximately 17,000 ohm-cm. The Curie temperature is selected so that it lies approximately 10° to 120° C. higher than the maximum temperature to be attained by the oil to be heated, typically between 120° and 220° C. In the case of a flowing quantity of only 0.3 liters per hour, the oil which is flowing through the pipe attains approximately 110° C. when a 220 volt power supply is used. The temperature of the ceramic conductor heating element 4 thereby maintains itself in a self-required manner at a temperature of 170° C., delivering from the heating element 4, 35 watts of filament power. This result is attained when the steepness $$\alpha = (\log \rho/\rho_o)\left(\frac{1}{T - Tc}\right)$$

of the rising resistance amounts to at least 20%/°C. If under the same conditions an oil quantity of 2 liters per hour flows through the pipe, the oil is heated to a temperature of 73° C. In this case the ceramic conductor small plate 4, gives off 70 watts because of the larger heat quantities transferred. However, the ceramic conductor heating element 4 still only attains a temperature of approximately 167° C.

Where the heating device is to be independent of whether 110 volts or 220 volts are applied, ceramic conductor material within a specific resistance of for example, $\rho$=4300 ohm-cm (where a 160° C. Curie temperature is again desired) should be selected. When operating at 110 volts, then an amount of oil flowing through at 2 liters per hour again heats, at a filament power of 70 watts, to 73° C. In the other extreme case, i.e., where there is an operating voltage of 220 volts and only 0.3 liters per hour of oil flowing, a heating to 170° C. is attained where the resistance/temperature slope, $\alpha$, is approximately 20%/°C. The cited values for $\rho$=17,000, or 4300 ohm-cm may be varied within a range, the upper limit of which lies at values of up to 20% larger than the cited $\rho$ values i.e., 5000 ohm-cm and 20000 ohm-cm, respectively. The lower limit of the variation range for $\rho$ values, in comparison to the above cited values, lies at values approximately lower by a factor of 10 i.e., 430 ohm-cm and 1700 ohm-cm, respectively. In any event, smaller values of $\rho$ lead to somewhat higher temperatures of the oil flowing through the pipe.

The use of the present invention allows great flexibility in the application of oil preheaters to actual installations. In the example above which allowed an operating voltage of between 110 and 220 volts with a range of oil flow rates between 0.3 and 2.5 liters per hour, a range of operation possibilities of 1:40 exists. This is calculated by multiplying the allowable range of oil flow rates, a factor of almost 10, by the range in power, which is proportional to the range in voltage, squared, i.e., 4.

While we have disclosed an exemplary structure to illustrate the principles of the invention, it should be understood that we wish to embody within the scope of the patent warranted hereon all such modifications as reasonably and properly come within the scope of our contribution to the art.

We claim as our invention:

1. A heating device for the preheating of heating oil in a range from 0.3 to 2.5 liters/hour which comprises:

a heat conduction body having portions defining an interspace within said body;

a plate-shaped ceramic PTC resistance heating element received in said interspace and providing good heat conduction from both planar surfaces of said heating element, said ceramic PTC conductor heating element having a thickness of between 0.5 and 2 mm, a Curie temperature of between 120° and 220° C., and consisting of material having a specific resistance, $\rho$, of 430 to 5,000 ohm-cm, as measured at a voltage between 110 and 220 volts and at the Curie temperature of said material;

means for attaching said heat conduction body in heat exchange-relationship to a pipe conveying the oil to be heated; and means for connecting said element to an electrical power source having a voltage between 110 and 220 volts, whereby said heating device may be used to heat heating oil flowing in the pipe such that the maximum temperature attained by said heating element over a range of heat transfer rates from said heat conduction body is relatively constant and is determined by the resistivity and Curie temperature of the ceramic material and not by the rate of heat transfer.

2. A heating device as described in claim 1 wherein said specific resistance, $\rho$, is 4300 ohm cm.

3. A heating device for the preheating of heating oil in a range from 0.3 to 2.5 liters/hour which comprises:

a heat conduction body having portions defining an interspace within said body;

a plate-shaped ceramic PTC resistance heating element received in said interspace and providing good heat conduction from both planar surfaces of said heating element, said ceramic PTC conductor heating element having a thickness of between 0.5 and 2 mm, a Curie temperature of between 120° and 220° C., and consisting of material having a specific resistance, $\rho$, of 1700 to 20,000 ohm-cm, as measured at 220 volts and at the Curie temperature of said material;

means for attaching said heat conduction body in heat exchange-relationship to a pipe conveying the oil to be heated;

means for connecting said element to a 220 volt electrical power source, whereby said heating device may be used to heat heating oil flowing in the pipe such that the maximum temperature attained by said heating element over a range of heat transfer rates from said heat conduction body is relatively constant and is determined by the resistivity and Curie temperature of the ceramic material and not by the rate of heat transfer.

* * * * *